US005354947A

United States Patent [19]

Kunimoto et al.

[11] Patent Number: 5,354,947

[45] Date of Patent: Oct. 11, 1994

[54] MUSICAL TONE FORMING APPARATUS EMPLOYING SEPARABLE NONLINER CONVERSION APPARATUS

[75] Inventors: Toshifumi Kunimoto; Yoichiro Ogai, Hamamatsu, both of Japan

[73] Assignee: Yamaha Corporation, Japan

[21] Appl. No.: 878,563

[22] Filed: May 5, 1992

[30] Foreign Application Priority Data

May 8, 1991 [JP] Japan ..... 3-102566
May 17, 1991 [JP] Japan ..... 3-034871

[51] Int. Cl.[5] ..... G10H 7/00; G10H 1/06

[52] U.S. Cl. ..... 84/622; 84/659; 84/630; 84/644

[58] Field of Search ..... 84/622, 626, 630, 659, 84/607, 641, 642, 661, DIG. 9, DIG. 10, DIG. 17, DIG. 29, 644, 670

[56] References Cited

U.S. PATENT DOCUMENTS 4,147,083 4/1979 Woron et al. ..... 84/622
4,479,238 10/1984 Spector ..... 381/61
4,736,333 4/1988 Mead et al. ..... 364/736
4,736,663 4/1988 Wawrzynek et al. ..... 84/627
4,984,276 1/1991 Smith ..... 84/630
4,991,218 2/1991 Kramer ..... 84/622 X
5,113,743 5/1992 Higashi ..... 84/672
5,117,729 6/1992 Kunimoto ..... 84/660
5,131,310 7/1992 Kunimoto ..... 84/622 X
5,136,917 8/1992 Kunimoto ..... 84/624
5,144,096 9/1992 Kunimoto ..... 84/659
5,187,313 2/1993 Inoue ..... 84/622

FOREIGN PATENT DOCUMENTS 57-176094 10/1982 Japan .

*Primary Examiner*—William M. Shoop, Jr.
*Assistant Examiner*—Jeffrey W. Donels
*Attorney, Agent, or Firm*—Graham & James

[57] ABSTRACT

An apparatus for forming musical tone signals includes a playing operator and a tone signal synthesizing section for simulating a natural musical instrument, wherein a part of the tone signal synthesizing section, that is a part selectable for tone synthesization with respect to a plurality of tones is provided as connectable from external, and wherein storage means for storing procedure and parameters for synthesizing a musical tone signal is further provided as connectable from external.

10 Claims, 10 Drawing Sheets

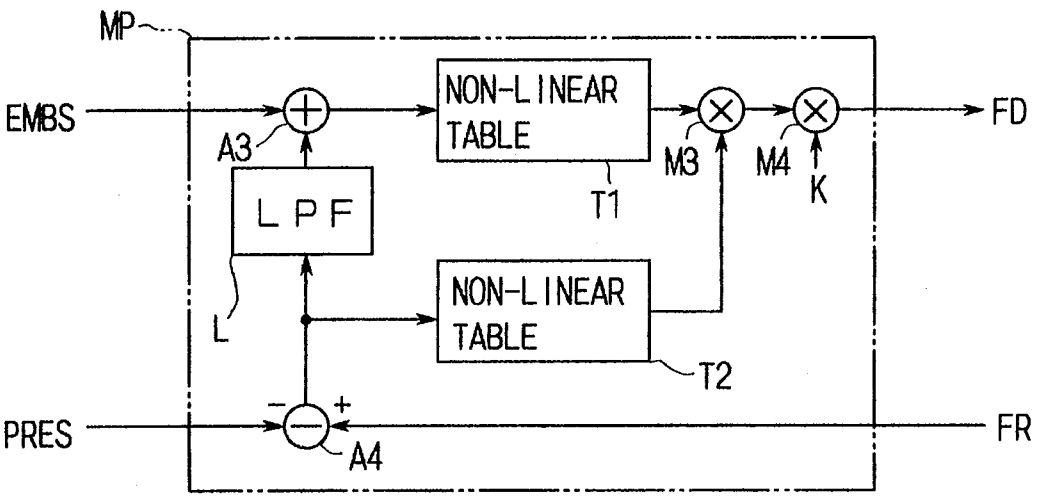
Fig. 8 (A)
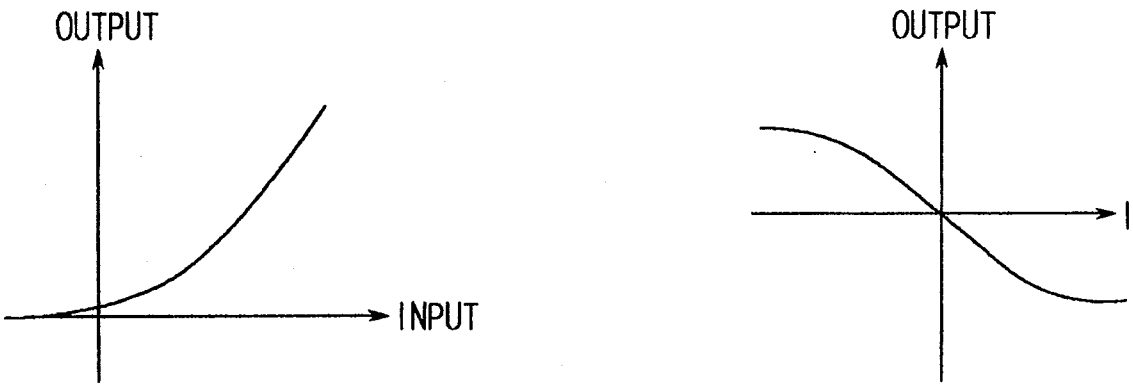
Fig. 8 (B)
Fig. 8 (C)

MUSICAL TONE FORMING APPARATUS EMPLOYING SEPARABLE NONLINER CONVERSION APPARATUS

BACKGROUND OF THE INVENTION

1. Field of the Invention

The present invention relates to an apparatus for forming musical tone signals to be used as a sound source for electronic musical instruments and the like.

2. Description of the Prior Art

In electronic musical instruments and the like, to form tone signals approximated to those by natural musical instruments there have been proposed physical model sound sources that simulate the sound generation principle of natural musical instruments.

These physical model sound sources, for example, one which simulates some woodwind instrument would be so arranged that it simulates the mouthpiece part that generates aerial vibrations by a non-linear circuit while the tone sound source simulates the pipe part, which allows aerial vibrations to propagate therethrough and is resonant only with aerial vibrations at certain frequencies, by a linear circuit.

FIGS. 8 and 9 are views showing a common physical model sound source that simulates the sound generation principle of woodwind instruments.

FIG. 8 is a view showing the construction of its non-linear part. This non-linear part simulates of the principle of forming aerial vibrations in single reed instruments such as saxophones. The non-linear part MP has a subtracter A4, which outputs a signal corresponding to a differential-pressure for causing a displacement of the reed by subtracting a breath pressure signal PRES, which is inputted from the mouthpiece of a playing control manipulator, from a feedback waveform signal FR, which has been fed back from the linear part. This signal corresponding to differential-pressure (differential-pressure signal) is inputted into a low-pass filter L and a non-linear table T2. In the non-linear table T2, input/output characteristic data is stored, such as shown in FIG. 8(*c*), which simulates the fact that even if the differential pressure becomes larger, the flow velocity saturates in such a narrow air path that the differential pressure and the flow velocity are not in proportion to each other. The low-pass filter L produces an output in which the high-band component of the differential-pressure signal has been removed. This is because the reed of the woodwind instrument will not respond to the high frequency component of input signal. The output of the low-pass filter L is inputted into an adder A3. The adder A3 receives an input of an embouchure signal EMBS, which represents how the mouth is tightened, i.e., pressure applied to the mouthpiece. The value resulting from adding these inputs is inputted into a non-linear table T1. The non-linear table T1, which simulates the amount of displacement of the reed with respect to an applied pressure, stores data shown in FIG. 8 (B). The output of the non-linear table T1 is a signal representing the area of air path at the reed tip of the mouthpiece. The output of the non-linear table T1 is inputted into a multiplier M3, to which the output of the non-linear table T2 (i.e. corrected differential pressure) is also inputted. With this arrangement, the multiplier M3 multiplies the differential pressure and the path area together, thereby calculating the flow velocity of air. The resulting output is further inputted into a multiplier M4, which produces an output by multiplying data that represents the flow velocity of the aforementioned air with a factor k that represents the impedance (air resistance) within the mouthpiece. The produced data is outputted to the pipe part as a tone pressure signal (traveling wave) FD. The circuitry described above allows a simulation of the process through which the flow velocity of air varies periodically to form compression waves.

FIG. 9 is a view showing the construction of the linear circuit. This linear circuit simulates the resonant state of air columns in the pipe body of a woodwind instrument (column-shaped air groups present in the pipe). The circuit is made up of a plurality of tone holes THn, pipe parts Dn which interconnect these tone holes, and a pipe tip TRM. It is noted that in this figure, only one piece of tone hole (TH1) is shown and two pipe parts (D1 and D2) are shown. These circuits are connected in series. The pipe parts Dn simulate a part of the pipe body with delay circuits DFn and DRn. More specifically, time required for sound waves (compression waves) to propagate increases depending on the length of the pipe, so that the delay time of the delay circuits corresponds to the length of the intervals of the tone holes. DF in these delay circuits represents a delay circuit for transmission of traveling wave signals and DR represents a delay circuit for transmission of reflected wave signals. TH simulates scattering of pressure waves, or forced formation of nodes of air vibration in the vicinity of tone holes. M1 and M2 represent multipliers; A1 and A2 represents subtracters; Aj represents an adder. In the TRM, a low-pass filter ML simulates attenuation in high band involved in reflection of aerial vibrations, while an inverter IV simulates the 180-degree phase inversion when reflection occurs at the open end.

Factors a1 and a2 of the THn, which are inputted into the multipliers M1 and M2 and then multiplied to the traveling wave signal and the reflected wave signal, respectively, are given different values depending on whether the tone hole is open or closed, which allows a simulation of change in tone pitch due to finger operation with the pipe instrument. When the tone hole is open, the following parameters will be given:

$$a1=2\Phi_1^2/(\Phi_1^2+\Phi_2^2+\Phi_3^2)$$

$$a2=2\Phi_2^2/(\Phi_1^2+\Phi_2^2+\Phi_3^2)$$

Meanwhile, when the tone hole is closed, the parameters will be given as:

$$a1=2\Phi_1^2/(\Phi_1^2+\Phi_2^2)$$

$$a2=2\Phi_2^2/(\Phi_1^2+\Phi_2^2)$$

where Φ1, Φ2, and Φ3 represent a front diameter of the resonant pipe, a rear diameter of the resonant pipe, and a diameter of the tone hole, respectively. Determination manner of the parameters is described in detail in U.S. patent application Ser. No. 07/511,060 filed on Apr.19, 1990.

Alternatively, when any string instrument is simulated, the friction of strings by the bows is simulated by a non-linear circuit, while vibration of strings is simulated by a linear circuit.

As shown above, the above-mentioned physical model sound sources have been provided in such a construction that all the parts for forming tone signals from the non-linear to linear circuits are in an integral form or a physically fixed form. In the case of woodwind instruments, the principle of forming aerial vibrations by the mouthpiece part would be approximately similar among single reed instruments such as a plurality of types of saxophones and clarinets, yet the length of pipe and the transmission characteristic of aerial vibrations are slightly different.

Likewise, when a string instrument is simulated, the vibration of strings is based on similar principle among plural kinds of string instruments, that is, friction by bows, the ways of resounding are different because the length and thickness of strings as well as in the size of the body are different among those instruments. These factors can be approximately simulated by changing the parameters of the delay circuits or others.

However, the conventional physical model sound sources, are constructed wholly as an integral unit as described above, can allow one sound source to generate sounds in only one type of instrument. Therefore, forming tones (tone signals) of a plurality of types of instruments necessitates providing plural sets of the entire circuit for respective types of instruments.

As another aspect of common electronic musical instruments, there have been adopted sound source circuits in which tone signals are formed in only one method. As a result of this, the CPU has only to drive a fixed tone formation algorithm, permitting use of fixed programs including a control program for tone generation and a program for supporting tone color edition. Thus, it has been taken for granted that such data is stored in a ROM within the instrument body.

Meanwhile, although even a sound source circuit of the FM synthesizing method would be able to generate various types of tones (waveforms), these tones could be realized by changing parameters for synthesizing (voicing data) in various ways while the method of synthesizing would not be changed. As a result, even in an electronic musical instrument which allows any external memory such as a cartridge to be connected thereto, only voicing data, which does not change any tone synthesizing method, can be fed from the external memory. Also, there have been proposed electronic musical instruments in which a plurality of control programs are stored in a memory and any one of the program is selected to change the tone formation algorithm. Yet this method would allow the selection only in a pre-stored range.

To form tone signals having their own characteristics, it is desirable that the tone formation algorithm itself be changed for each tone, which was impossible for conventional electronic musical instruments.

SUMMARY OF THE INVENTION

Accordingly, an object of the present invention is to provide an apparatus for forming musical tone signals which has solved the foregoing problems by an arrangement that sharable parts are provided as fixed parts and those to be necessarily changed are as discrete ones so as to be connectable and separable.

Another object of the present invention is to provide an electronic musical instrument which has solved the foregoing problems by an arrangement that programs and data defining the algorithm are stored in external memory.

In order to achieve the aforementioned objects, the present invention provides an apparatus for forming musical tone signals, comprising: a playing control to be played by a player; a first tone signal synthesizing section fixedly provided to the apparatus, for synthesizing a musical tone signal according to a playing signal inputted from the playing control by simulating a natural musical instrument, the first tone signal synthesizing section serving as common part of tone generation with respect to a plurality of tones; a second tone signal synthesizing section for simulating the natural musical instrument in cooperation with the first tone signal synthesizing section, the second tone signal synthesizing section being selectable for tone synthesization with respect to a plurality of tones; and connection means for allowing the second tone signal synthesizing section to be connected from external. The second tone signal synthesizing section is provided with delay means for delaying a vibration signal to be inputted from the first tone signal synthesizing section, and filter means. The first tone signal synthesizing section is provided with a non-linear table for carrying out the above-mentioned simulation, while the second tone signal synthesizing section is provided with the delay means and the filter means, and parameter storage means for storing parameters to determine their characteristics, allowing the non-linear table and the parameter storage means to be connected thereto from external.

Furthermore, the apparatus for forming musical tone signals may be provided with procedure for synthesizing a musical tone signal in the tone signal synthesizing means and parameters, and the storage means can be connectable with the apparatus from external. With the above arrangement, the first tone signal synthesizing section generates a vibration signal by non-linear arithmetic processing. To generate this vibration signal, in the case of a wind instrument, how the reed vibrates is simulated with the pressure of breath blown-in by the player and reflected waves from the pipe part. In the case of a string instrument, the system by which the vibrations of strings are sustained is simulated with the correlation between the friction of a string by the bow and the vibration of the string itself. The second tone signal synthesizing section is selectable for tone synthesization with respect to a plurality of tones, and therefore it is possible to synthesize an optional musical tone signal by selecting this section that allows itself to be connected to the apparatus from external. Also, by arranging the storage means for storing procedure and parameters for synthesizing a musical tone signal, it is possible to generate a musical tone signal corresponding to the algorithm stored in the storage means that has been connected.

BRIEF DESCRIPTION OF THE DRAWINGS

These and other objects and features of the present invention will become apparent from the following description taken in conjunction with the preferred embodiment thereof with reference to the accompanying drawings, in which:

FIGS. 8(A)–8(C) and FIG. 11 are views showing the construction of a common non-linear part.

DETAILED DESCRIPTION OF THE PREFERRED EMBODIMENTS

Figure 1:
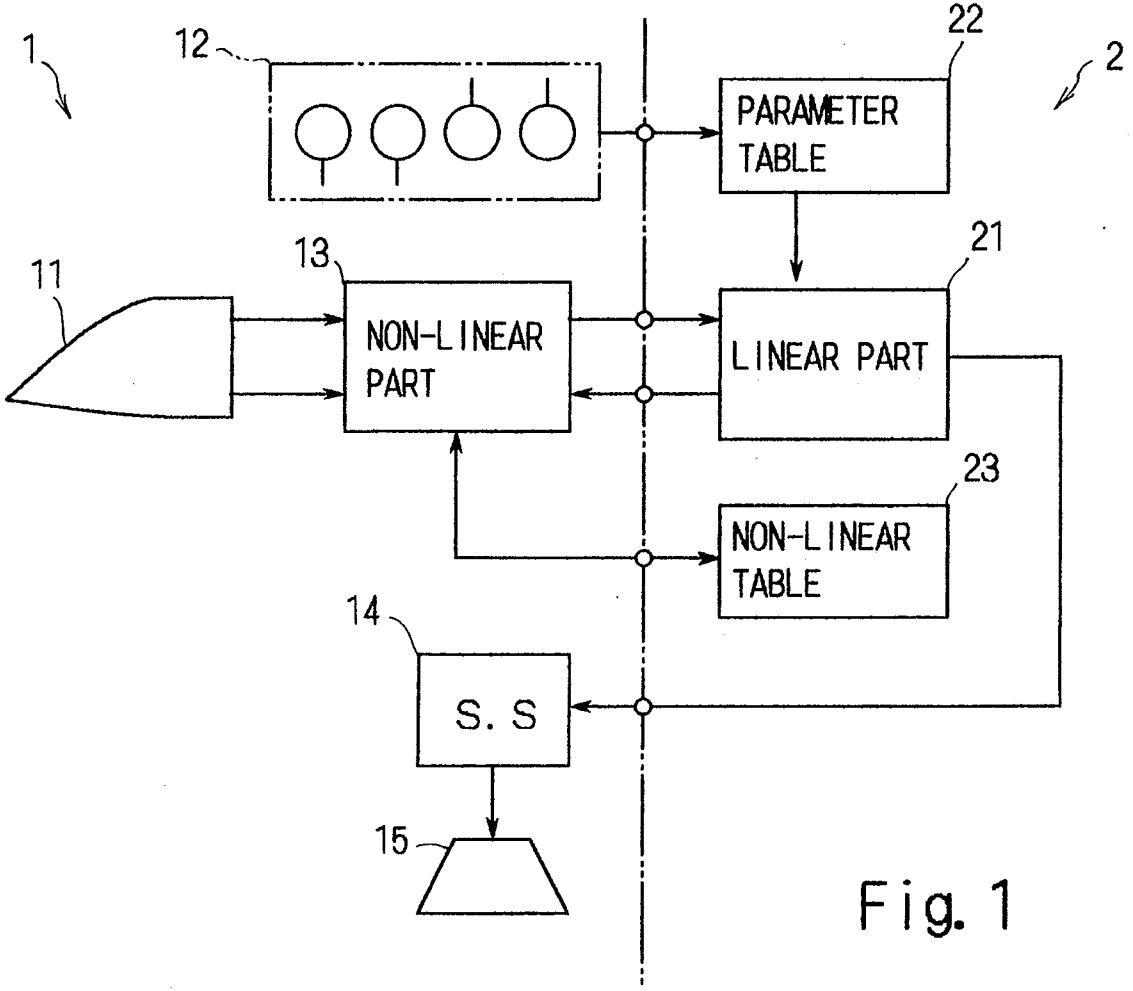
FIG. 1 is a view showing the construction of an electronic musical instrument embodying the present invention.
Figure 9:
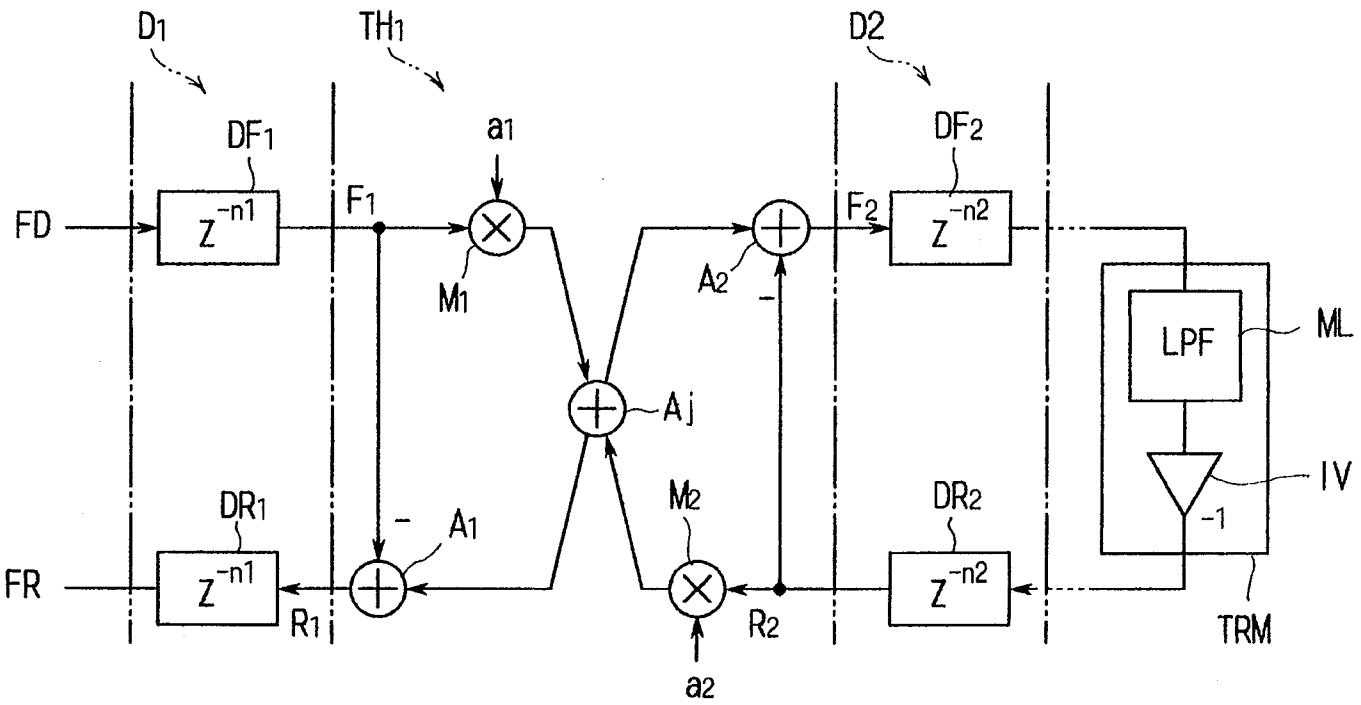
FIG. 9 is a view showing the construction of a common linear part.

FIG. 1 is a block diagram of an electronic musical instrument embodying the present invention. This electronic musical instrument is shaped like a woodwind instrument such as a saxophone, allowing itself to be played by the same operation as with a natural musical instrument. A wind instrument body 1 has a cartridge 2 connected thereto, and is equipped with a mouthpiece 11 and a key system 12 having plural keys. The mouthpiece 11 is equipped with an embouchure sensor and a breath pressure sensor, whose detection data EMBS and PRES are inputted into a non-linear part 13. The non-linear part, a circuit that simulates the process through which aerial vibrations are generated in the mouthpiece, is constructed approximately in the same way as in the circuit in FIG. 8 described above. A non-linear table 23 (whose characteristics are shown in FIG. 8 (B), (C)), which determines the vibration signal to be generated by the non-linear part 13, is set in the cartridge 2 and connected to the non-linear part 13 when the cartridge is connected thereto. The non-linear part is interconnected with a linear part 21 of the cartridge. The linear part 21 is a circuit for simulating the propagation of aerial vibrations of the pipe body, similar to the circuit in FIG. 9 described above. The propagation of aerial vibrations differs depending on the operation of the key system 12. More specifically, opening and closing the tone hole will affect standing waves to be formed in the pipe. To simulate this, the on/off states of keys in the key system 12 to designate a pitch of a tone to be generated is inputted into a parameter table 22, and the value of the parameter table is in turn inputted into the linear part 21. According to this value, delay time and the like are determined. The signal transferred by the linear part 21 is inputted into a sound system 14 as a tone signal.

In the sound system, this signal is amplified and outputted from a loudspeaker 15.

The cartridge 2, which is connectable with and separable from the instrument body 1, can be provided in any plural number. If data which simulate the principles of tone generation of a desired musical instrument, for example, of B, clarinet, E, clarinet, alto saxophone, tenor saxophone, and the like are stored each in the cartridges, mere changing the cartridge will allow a variety of musical instruments to be simulated.

Figure 2:
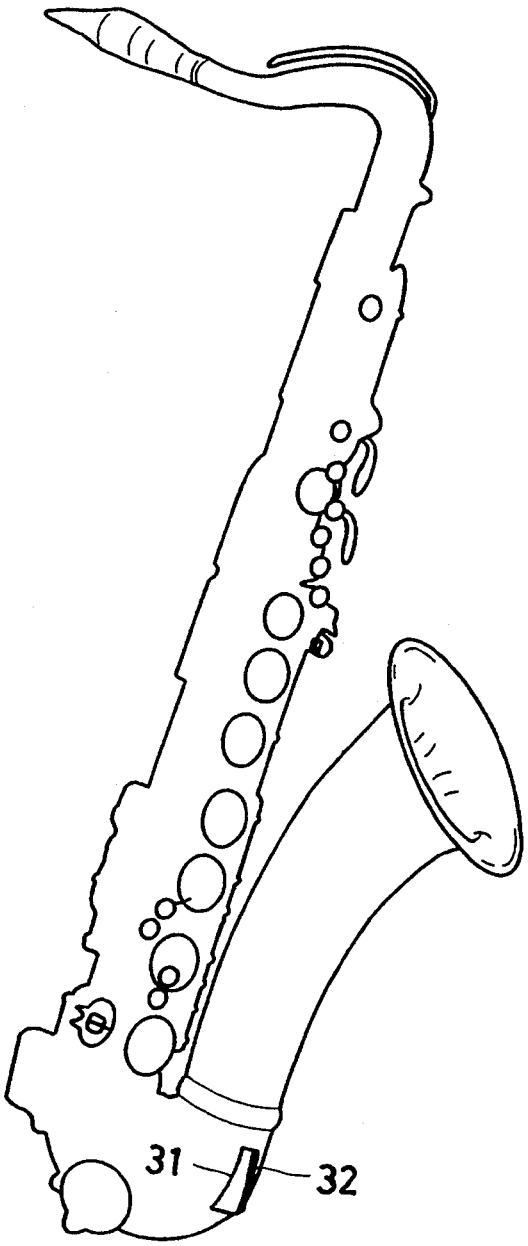
FIG. 2 is a view showing a practical embodiment of the invention.

Various embodiments are possible to practically implement such an electronic musical instrument. For example, as shown in FIG. 2, the instrument is provided in a shape similar to a saxophone, in which case it is possible to provide a cartridge insertion hole 31 at a portion of its pipe part and insert a cartridge 32 for a saxophone, a clarinet, or the like into the hole so that their tones can be realized.

Figure 3:
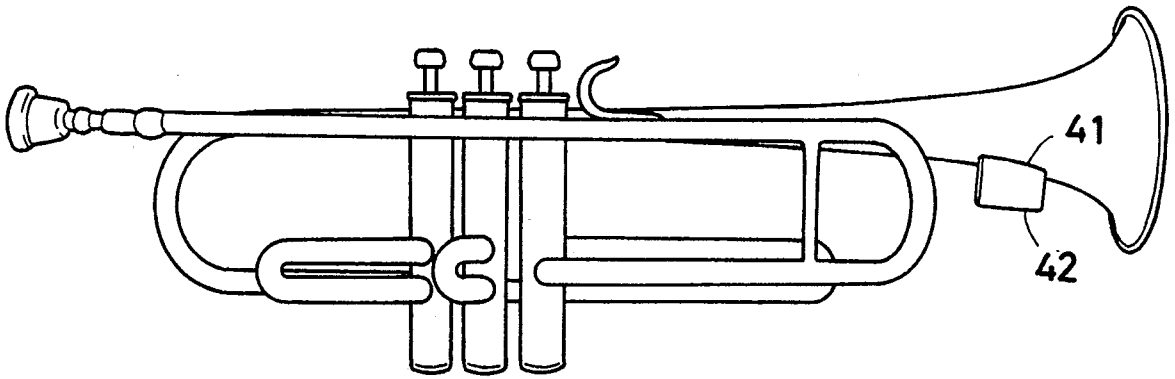
FIG. 3 is a view showing another practical embodiment of the invention.

Further, if the instrument is provided in a shape like a trumpet as shown in FIG. 3, it can be played in a way of brasses. In such a case, a cartridge insertion hole 41 may be provided in the vicinity of the opening and a cartridge 42 for a trumpet, a horn, or the like is inserted into the hole so that various tones can be realized.

Yet further, it is also possible to provide a cartridge insertion hole to a sound source unit (not shown) for use of so-called rack mount, in which case with a cartridge inserted therein any desired instrument unit (e.g. keyboard, wind instrument type unit, guitar type unit) can be connected thereto and played.

It is to be noted that although the linear part 21 and the non-linear table 23 of the non-linear part are provided as a cartridge discretely in the above-described embodiment, the non-linear table may be provided as a fixed unit, only the linear part being provided discrete.

Furthermore, since all the delay circuits, multipliers, adders, low-pass filters, which compose together the linear part, can be realized with a single digital signal processor, it is possible to provide this digital signal processor on the body side, where only their parameters of delay time, cut-off frequencies, and the like are separately provided (in the form of cartridges), for example, as a memory card, which is inserted therein to simulate various types of instruments. In other words, since the non-linear and linear parts are both provided on the body side, it is also possible to provide in the form of cartridges only the non-linear table that defines the actual operation of the non-linear part and the parameter table that defines that of the linear part.

It is to be noted that although in the above-described embodiment the number of tones that can be generated at the same time has not been referred to, generating a plurality of tones is easily made feasible by time-sharing operation. Also, when the non-linear table is provided within the body, it may be arranged that a plurality of such tables are provided and one of them is selected according to the linear part which has been connected.

It is further possible to provide a plurality of cartridge insertion holes, so that a plurality of tones can be played or automatically played simultaneously.

Although the above embodiment has been described with respect to a physical model sound source of woodwind musical instruments (single reed instruments), the invention can also be applied to that of string musical instruments and others.

As described above, according to the present embodiment, there is provided an apparatus for forming musical tone signals, composed of a vibration generating part and a resonant part, wherein parts common in a plurality of tones (tone signals) and those different therein are discriminated, only the different parts being provided discrete so as to be connectable and separable. Thus, it has been made possible to form a plurality of tones by a minimum addition of components.

Figure 4:
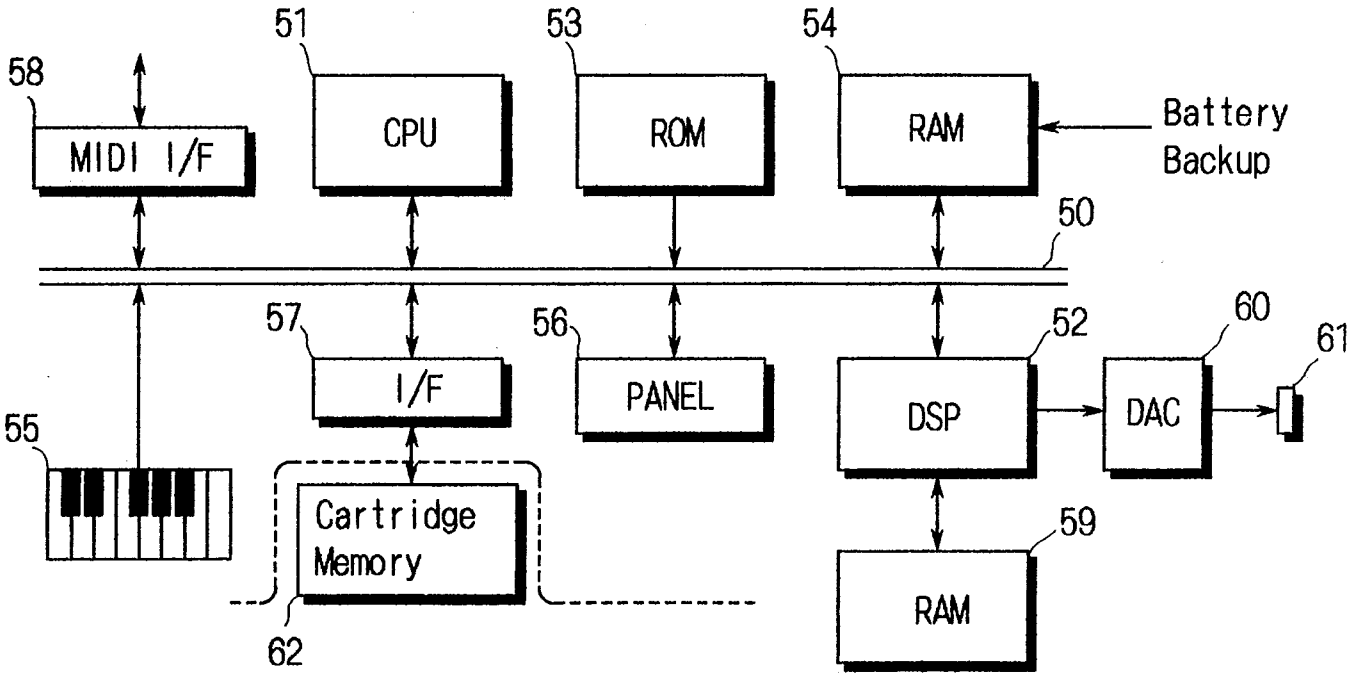
FIGS. 4 and 10 are views showing the construction of an electronic musical instrument embodying the present invention.

FIG. 4 is a block diagram of an electronic musical instrument to which the present invention has been applied. This electronic musical instrument is provided with a CPU 51 for controlling operation of the whole instrument and a DSP 52 for forming tone signals, where DSP 52 denotes a high-speed microprocessor for forming tone signals in compliance with programs and data. These parts are connected to one another via a bus 50, to which there are further connected a ROM 53, a RAM 54, a keyboard 55, a control panel 56, an interface 57, and an MIDI interface 58.

The interface 57 is connected to a slot provided to the control panel, into which slot a cartridge memory 62 is inserted. The cartridge memory 62 has stored a control program for controlling the tone synthesizing algorithm, a program for carrying out the setting of tone waveform edition and the like with the control panel, parameters (voicing data) to be treated within the control program, and the like. These data are to be loaded to the RAM 54. The cartridge memory 62 has also stored parameters (voicing data) to be used by the DSP 52, microprograms for controlling the operation of the DSP 52, and others. These data are to be loaded to a RAM 59 controlled by the DSP 52. Further stored in the cartridge memory 62 is graphic data for visually recognizing a synthesizing algorithm. This data is displayed onto an LCD of the control panel 56 for use in tone color edition. Since the tone formation algorithm can be given in various types, it is important to have both the program for DSP and the graphic data for algorithm at the same time. By storing not only parameters but also their display attributes (e.g. linear, dB), addresses on the CPU/DSP, upper and lower limits of their values together, the program for tone edition can be made independent of the tone formation algorithm, whereby all the programs that can be used for tone formation algorithm can be stored in the ROM 53. Also stored in the ROM 53 are programs for loading data of the cartridge memory 62 to the RAMs 54, 59, programs for controlling data transmission/reception via the MIDI interface 58, and the like. The loading of data stored in the cartridge memory 62 is performed when the cartridge memory 62 is inserted and power is turned on. In the keyboard 55, a playing unit, there are provided a sensor for detecting on/off switching of each key, and a sensor for detecting the strength of depression when each key is turned on/off. In the control panel 56 there are provided a tone selector switch, a display, and others.

Figure 5:
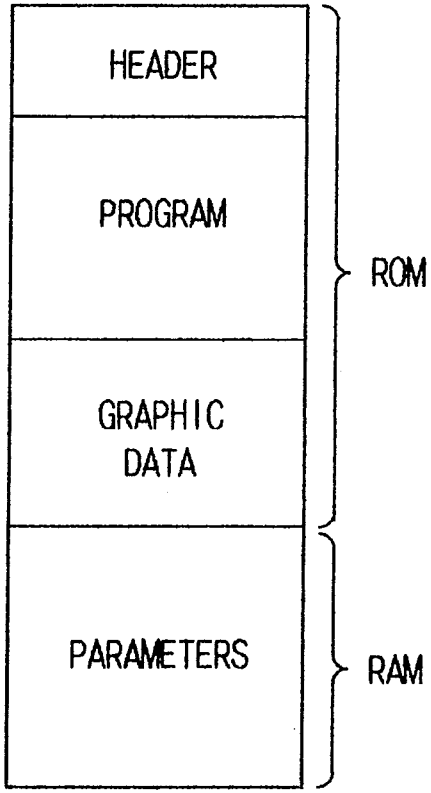
FIGS. 5(A) and 5(B) are views showing the construction of a cartridge memory of the same instrument.
Figure 5:
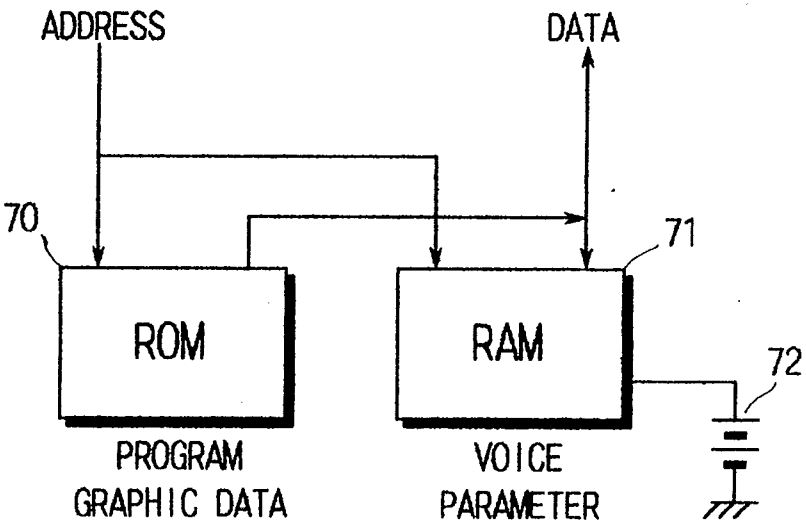

FIG. 5 is a view showing an exemplary construction of the aforementioned cartridge memory 62. The cartridge memory 62 is composed of a ROM 70 and a battery(32)-backed-up S-RAM 71. The ROM 70 has stored programs, graphic data, and others, while the S-RAM 71 has stored voicing data.

Figure 6:
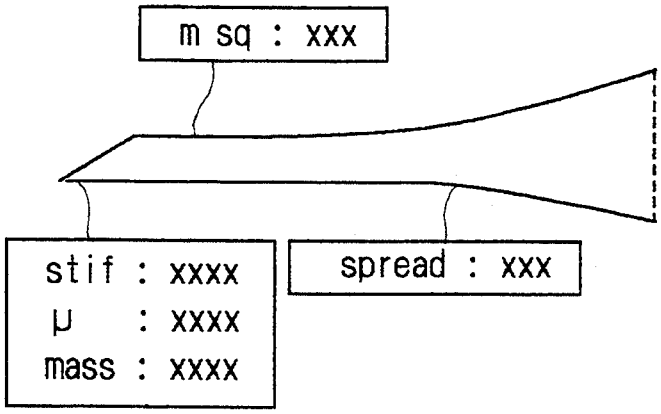
FIG. 6 is a view showing an example of graphic display of the instrument.

FIG. 6 is a view showing an example of display of graphic data stored in the cartridge memory 62. This figure illustrates graphical display in the case where the tone synthesizing algorithm of the DSP 52 is of a type corresponding to the physical model sound source for single reed instruments. The whole schematical view shows the shape of an actual instrument, where physical parameters are presented near their corresponding parts. In the figure, the symbol xxx denotes the display of their values. By moving the cursor onto the places of the values, the values can be increased or decreased.

Figure 7:
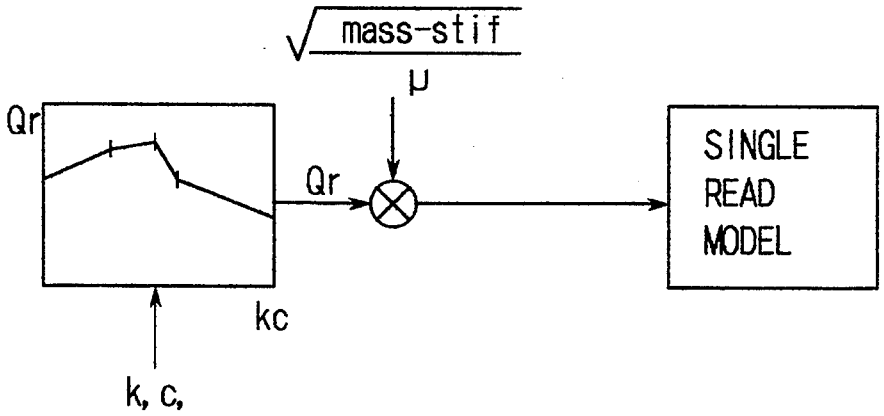
FIG. 7 is a view showing the method of processing parameters in the instrument.

FIG. 7 is a view for explaining how the parameters are given to the physical model sound source in the case of FIG. 6. In FIG. 7, an exemplary model of the vibration generating part of the reed is shown. The graph on the left side shows the input/output relation of a key code KC to a reed resonance value Qr table. This table, stored in the cartridge memory 62, is used directly or by being loaded to the RAM 59. Stiffness (stif), frictional resistance ($\mu$), mass (mass) of the display at the reed part modify key-scaled value Qr (resonance strength of the reed), Fr (resonance frequency of the reed), and Gr (transfer gain of the reed). Although the figure shows a simplified multiplication, more complex computation is required in actual case.

First described are the relations of stif, $\mu$, and mass to Qr, Fr, and Gr. These parameters are correlated in the following equations:

$$Fr=(\text{stif}/\text{mass})^{0.5}/2\pi$$

$$Or=(\text{stif}*\text{mass})^{0.5}/\mu$$

$$Gr=S/\text{stif}$$

where S is the effective area of the reed, herein treated as a constant. Whereas the parameters have the relations shown above, Fr, Or, and Gr are given directly from such a key scale table as shown in FIG. 7, so that stif, mass, and $\mu$ given on the screen cannot take part in determining them. These parameters, however, can be used to modify preset (i.e. key scaled) Fr, Or, and Gr. Assuming that stif, mass, and $\mu$ take values of $\pm 1$ for each of them, actual values of Fr, Or, and Gr (Fra, Qra, and Gra) are calculated by the following equations:

$$Fra=Fr*10^{0.5(stif-mass)-\log(2\pi)}$$

$$Qra=Qr*10^{0.5(mass+stif)-\mu}$$

$$Gra=Gr*10^{\log(S)-stif}$$

where log( ) is the common logarithm. As a result, the Fra, Qra, and Gra are changed (modified) in the range of 1/10 to 10 with respect to Fr, Qr, and Gr.

The method shown above can be used to modify various physical parameters such as spread, which represents the spread of pipe in FIG. 6, and m sq, which is the thickness of the mouthpiece. Also, it can be applied as a mechanism for assigning model parameters for various instruments such as jet reed type, lip reed type, string type, percussion type, and other instruments, as well as single reed type instruments.

Although in the above embodiment a keyboard has been used as the playing unit, it is possible to connect any wind instrument type playing unit as well. Also, even if it is not connected directly to the instrument body, playing data can alternatively be inputted via the MIDI interface 58. In the above embodiment, programs and data are used by being loaded to the RAM from the cartridge memory 62. However, when programs are stored in the memory within the cartridge in such form that they can be operated by directly accessing thereto from the CPU, the need of loading data of programs and others to the RAM from the cartridge memory can be eliminated. In such a case, the RAM contained in the CPU may be of a minimum capacity as much as required.

Moreover, the electronic musical instrument constructed as described above is so arranged that it is first activated from the ROM contained in the CPU when power is turned on, and according to the program of the ROM, it initializes the hardware and does other tasks so that it checks whether or not there is any cartridge (floppy disk), and further in some cases control software for the CPU/DSP contained therein is loaded to their respective RAMs and executed. Other than this method, it may also be arranged that no ROM is provided to the CPU and reset is effected when a cartridge is inserted or when power is tuned on, and immediately thereafter control is moved to the program within the cartridge. In this case, the cartridge is necessarily mapped in the addresses of the CPU.

In addition, mode data that can be stored in the cartridge memory in the above example are listed below:

- control codes given to the tone synthesization CPU (DSP);
- control/voicing codes given to the tone control CPU;
- graphical data and parameter display locations such as shown in FIG. 6;
- modifying parameter data such as parameter values in FIG. 6; and
- key scale data in FIG. 7 and calculation equations for modifying their values.

Further, parameters on the screen in FIG. 6 may be used not as modifying data but as parameter values themselves.

Figure 10:
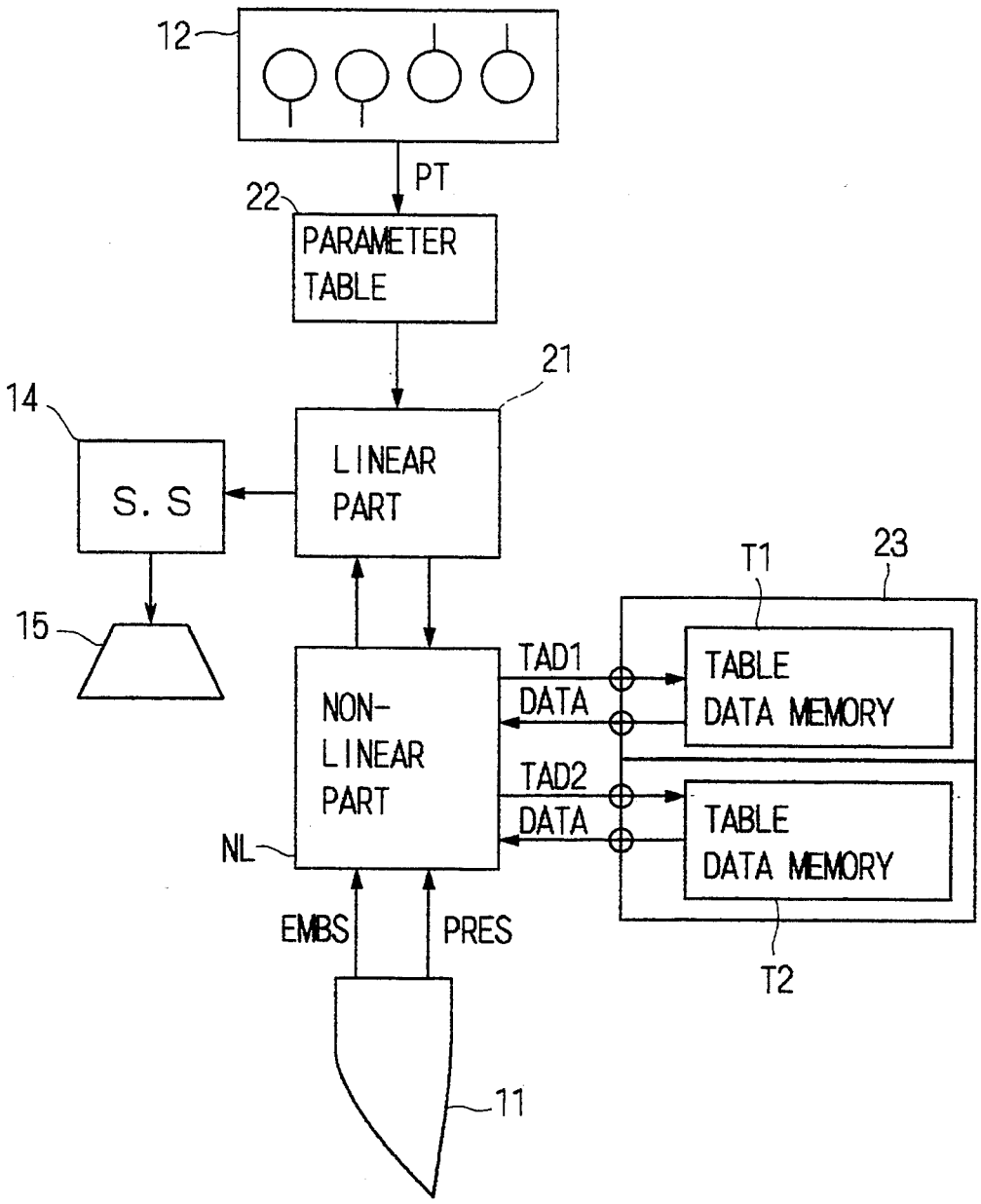
Figure 11:
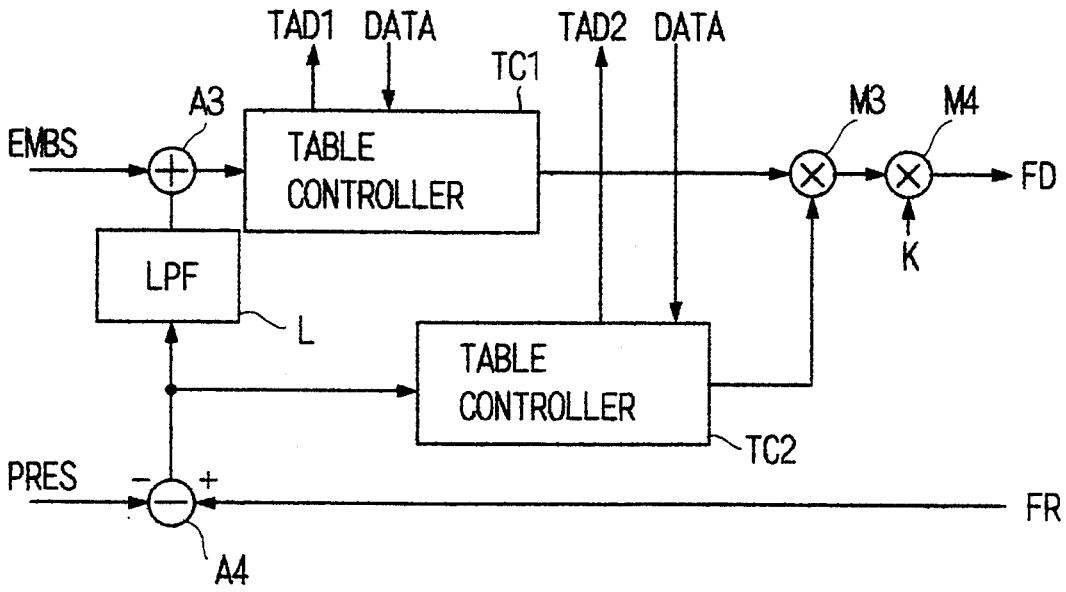

Next, a third embodiment of the present invention is described with reference to FIG. 10 and FIG. 11. FIG. 11 is a block diagram showing the general construction of an electronic musical instrument of the third embodiment of the invention. In the figure, like sections of the same construction as in FIG. 1 are designated by like numerals. This electronic musical instrument is so arranged as to simulate a saxophone, as in the first embodiment, with a mouthpiece 11 and a key system 12 provided thereto. The mouthpiece 11 is provided with an embouchure sensor for detecting how the lip of the player is tightened, and a breath pressure sensor for detecting the breath pressure of the player, so that detection data of these sensors are outputted as an embouchure signal EMBS and a breath pressure signal PRES, respectively.

The key system 12 is provided with a plurality of keys, which are to be depressed by the player. When those keys are depressed by the player in various patterns, data PT representing a pattern in which the keys have been depressed is outputted.

The data PT outputted from the key system 12 is inputted into the parameter table 22, which in turn selects and outputs parameters to be given to the linear part 21 according to the input data PT. That is, parameters are selected so that the tone pitch will be the same as when the player plays a saxophone with the same patterns in which the keys are depressed.

The parameters selected by the parameter table 22 are multiplication factors a1, a2, and the like representing the open/closed state of the tone hole. These multiplication factors, which correspond to the open/closed state of the tone hole in the linear part 21 in conjunction with FIG. 9 previously mentioned, serve to control the open state and the closed state of the tone hole of the linear part 21 in correspondence to the depressing pattern of the key system. By this control, effective delay time is determined so that the resonance frequency of a loop network formed through the linear part 21 and a non-linear part NL corresponds to a desired tone pitch.

In addition, the linear part 21 is the same as in the previously described case, its detailed description being omitted.

Meanwhile, the embouchure signal EMBS and the breath pressure signal PRES outputted from the mouthpiece 11 is inputted into the non-linear part NL.

FIG. 11 shows the internal construction of the non-linear part NL. The non-linear part NL in FIG. 11 differs from the prior-art non-linear part as shown in FIG. 8 in that the non-pitch linear table is divided into a table controller and a table data memory, in which the table data memory only being provided in the form of a cartridge as separate memory. The embouchure signal EMBS inputted from the mouthpiece 11 is added with an output signal from a low-pass filter L, described later, at an adder and then inputted into a table controller TC1. The table controller TC1 transfers the value of the input signal as an address TAD1 to a table data memory T1 within the cartridge 23 in FIG. 10 while the table data memory outputs data stored at the location corresponding to the address TAD1, to the table controller TC1. It is to be noted that the table data memory T1 has stored a table which serves for performing such conversion as shown in FIG. 8(B).

The table controller TC1, receiving the output data of the table data memory T1, outputs the data as it is while the multiplier M3 multiplies the output signal of the table controller and the output signal of another table controller TC2 together. The table controller TC2, similar to the table controller TC1, accesses a table data memory T2 within a cartridge 24 independent of the cartridge 23. It is noted that the table data memory T2 has stored a table for performing such conversion as shown in FIG. 8(C).

The multiplier M3 multiplies the output signal of the table controller TC1 and the output signal of the table controller TC2 together, and then outputs the multiplication result as its output signal to a multiplier M4. The multiplier M4 multiplies the output signal of the multiplier M3 and a factor k corresponding to the acoustic impedance of the pipe to thereby generate a traveling wave signal FD, transmitting the FD to the linear part 21.

The linear part 21, as previously described, performs a linear treatment corresponding to propagation of sound waves by parameters fed from the parameter table 22, so that a feedback signal FR returns to the non-linear part NL.

The non-linear part NL subtracts the breath press signal PRES from the feedback signal FR at a subtracter A4, and then outputs the subtraction result to the low-pass filter L and the table controller TC2. At the low-pass filter L the high component of the signal is attenuated and outputted to the adder A3.

The non-linear part NL, arranged as a whole to simulate the reed characteristics of a saxophone, starts vibration in compliance with the feedback signal, the embouchure signal EMBS, and the breath pressure signal PRES reflected via the linear part 21. The principle of vibration itself is the same as in FIGS. 8 and 9, its description being omitted.

According to the third embodiment as described above, since the table data part of the non-linear table is separated from the electronic musical instrument body as cartridge memory removable therefrom, it is possible to prepare a variety of cartridge memories with various and subtle changes in their non-linear conversion characteristics, to thereby realize differences in tones due to various types of non-linear conversion by replacing the cartridge, as is the case when the player of a saxophone exchanges among various mouthpieces and reeds for trial playing so as to accomplish the player's desired tone. In other words, the instrument characteristic (i.e. tuning characteristic) that the player desires can be achieved in similar manner as the tuning of a saxophone is carried out by replacing the mouthpiece, thus allowing a simulation of playing situation more approximated to that by natural musical instruments.

Although the cartridge 23 and the cartridge 24 are provided independently of each other in the above-described third embodiment, it is also possible to join the two into one cartridge.

As described above, according to the electronic musical instrument of the present embodiment, algorithm (procedure) and data for forming tone signals are stored in external memory, and arranged to be connectable to the instrument, whereby tone signals can be formed by various algorithms without requiring internal memory to be increased in capacity.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A musical tone forming apparatus for forming musical tone signals employing a tone synthesizer of the type including a closed loop path including a non-linear processing portion and a delay portion receiving an input from the non-linear processing portion and providing an output back to the non-linear processing portion, the non-linear processing portion receiving an excitation signal and converting a signal based upon the excitation signal and the output of the delay portion in accordance with a non-linear conversion characteristic and providing the converted signal to the delay portion, the apparatus comprising:

a playing operator to be played by a player;

a first tone signal synthesizing section forming a portion of the tone synthesizer physically and fixedly provided to the apparatus, for synthesizing a musical tone signal according to a playing signal inputted from the playing operator, the first tone signal synthesizing section serving as a common part of tone synthesization with respect to a plurality of tone colors, wherein said first tone signal synthesizing section includes arithmetic means for receiving a playing signal constituting said excitation signal, which is inputted from said playing operator, and a signal corresponding to the output of the delay portion and derived from said second tone signal, synthesizing section and performing an arithmetic operation with respect to the received signals, and non-linear conversion means for generating a vibration signal by converting the output of the arithmetic means in accordance with said non-linear conversation characteristic;

a second tone signal synthesizing section separably provided from said first tone signal synthesizing section for synthesizing the musical tone signal in cooperation with the first tone signal synthesizing section, the second tone signal synthesizing section including means defining at least said non-linear conversion characteristic and being selectable for tone synthesizing with respect to a plurality of tones and connection means for connecting the second tone signal synthesizing section to the first tone signal synthesizing section to thereby form a unitary musical tone forming apparatus, wherein said means defining said non-linear conversion characteristic includes a non-linear table, and said connection means connects the table to the non-linear conversion means.

2. A musical tone forming apparatus for forming musical tone signals according to claim 1, wherein said second tone signal synthesizing section includes plural non-linear tables defining different non-linear conversion characteristics.

3. A musical tone forming apparatus for forming musical tone signals according to claim 1, wherein the apparatus includes a body which is shaped into the form of an actual musical instrument, and said connection means includes a cartridge insertion hole provided to a specified portion of the apparatus body, said second tone signal synthesizing section comprising a cartridge and being connectable with the apparatus by inserting the cartridge into the cartridge insertion hole.

4. A musical tone forming apparatus for forming musical signals employing a tone synthesizer of the type including a closed loop path including a non-linear processing portion and a delay portion receiving an input from the non-linear processing portion and providing an output back to the non-linear processing portion, the non-linear processing portion receiving an excitation signal and converting a signal based upon the excitation signal and the output of the delay portion in accordance with a non-linear conversion characteristic and providing the converted signal to the delay portion, comprising:

a playing operator to be played by a player;

a first tone signal synthesizing section physically and fixedly provided to the apparatus, for synthesizing a musical tone signal according to a playing signal inputted from the playing operator, the first tone signal synthesizing section serving as common part of tone synthesization with respect to a plurality of tones; and a second tone signal synthesizing section separably provided form said first tone signal synthesizing section for synthesizing the musical tone signals in cooperation with the first tone signal synthesizing section, the second tone signal synthesizing section including means defining at least said non-linear conversion characteristic and being selectable for tone synthesizing with respect to a plurality of tones, wherein the first tone signal synthesizing section includes arithmetic means for receiving a playing signal constituting the excitation signal, which is inputted from the playing operator, and a signal corresponding to the output of the delay portion and derived from the second tone signal synthesizing section and performing an arithmetic operation with respect to the received signals, and non-linear conversion means for generating a vibration signal by converting the output of the arithmetic means according to a non-linear table, and the second tone signal synthesizing section includes delay means for delaying the vibration signal to be inputted from the first tone signal synthesizing section, filter means for filtering the vibration signal, parameter storage means for storing parameters to determine characteristics of the delay means and the filter means and said non-linear table, wherein the second section comprises connection means for connecting the non-linear table.

5. A musical tone forming apparatus for forming musical tone signals according to claim 4, wherein said connection means further allows said parameter storage means to be connected from a location external to said apparatus.

6. A musical tone forming apparatus for forming musical tone signals according to claim 4, wherein the apparatus includes a body which is shaped into form an actual musical instrument, and said connection means includes a cartridge insertion hole provided to a specified portion of the apparatus body, said second tone signal synthesizing section comprising a cartridge and being connectable with the apparatus by inserting the cartridge into the cartridge insertion hole.

7. A musical tone forming apparatus for forming musical tone signals, comprising:

a playing control to be played by a player;

a main body;

tone signal synthesizing means contained within the main body for synthesizing a tone according to a playing signal derived from the playing control, the synthesizing means including a closed loop path including a non-linear processing portion and a receiving an input from the non-linear processing portion and delay portion providing an output back to the non-linear processing portion, the non-linear processing portion receiving an excitation signal and converting a signal based upon the excitation signal and the output of the delay portion in accordance with a non-linear conversion characteristic and providing the converted signal to the delay portion;

storage means for storing a program defining processing steps involved in synthesizing a musical tone signal in the tone signal synthesizing means and parameters for use of synthesizing a musical tone signal; and connection means for connecting the storage means to the main body.

8. An apparatus for forming musical tone signals according to claim 7, wherein said tone signal synthesizing means includes a RAM, so that the procedure of synthesizing a musical tone signal and the parameters stored in said storage means are loaded to the RAM before use.

9. An apparatus for forming musical tone signals according to claim 7, wherein said storage means further includes graphic data for displaying said procedure of synthesizing a musical tone signal in graphic form.

10. An apparatus for forming musical tone signals according to claim 7, wherein said storage means is composed of a ROM for storing said procedure of synthesizing a musical tone signal and a battery backed-up RAM for storing said parameters.

* * * * *